US012788156B2

(12) United States Patent
Ryan et al.

(10) Patent No.: US 12,788,156 B2
(45) Date of Patent: Nov. 10, 2026

(54) LOUNGE CHAIR WITH COVER

(71) Applicant: OUTER, Inc., Santa Monica, CA (US)

(72) Inventors: Patrick Ryan, Los Angeles, CA (US); Sammy Tsang, Alameda, CA (US); Terry Kang Lin, San Francisco, CA (US); Scott Sullivan, San Francisco, CA (US)

(73) Assignee: OUTER, INC., Santa Monica, CA (US)

( * ) Notice: Subject to any disclaimer, the term of this patent is extended or adjusted under 35 U.S.C. 154(b) by 257 days.

(21) Appl. No.: 18/585,867

(22) Filed: Feb. 23, 2024

(65) Prior Publication Data

US 2024/0268566 A1 Aug. 15, 2024

Related U.S. Application Data

(63) Continuation of application No. PCT/US2024/015484, filed on Feb. 13, 2024.

(60) Provisional application No. 63/484,766, filed on Feb. 14, 2023.

(51) Int. Cl.

| | |
|---|---|
| ***A47C 31/11*** | (2006.01) |
| ***A47C 1/14*** | (2006.01) |
| ***A47C 31/00*** | (2006.01) |

(52) U.S. Cl.

CPC ..... *A47C 31/11* (2013.01); *A47C 1/143* (2013.01); *A47C 31/003* (2013.01)

(58) Field of Classification Search

CPC ..... A47C 31/11; A47C 31/003

See application file for complete search history.

(56) References Cited

U.S. PATENT DOCUMENTS

| | | | | |
|---|---|---|---|---|
| 4,877,288 | A * | 10/1989 | Lee | A47C 1/143 297/229 |
| 5,326,152 | A | 7/1994 | Baron | |
| 5,620,229 | A * | 4/1997 | Ledford | A47C 4/52 297/229 |
| 6,626,491 | B1 * | 9/2003 | Blome | A45F 4/08 297/229 |

(Continued)

FOREIGN PATENT DOCUMENTS

| | | | |
|---|---|---|---|
| GB | 2579051 | A | 6/2020 |
| WO | 2019222276 | A1 | 11/2019 |

OTHER PUBLICATIONS

International Search Report filed in PCT/US2024/015484 dated May 6, 2024.

*Primary Examiner* — David R Dunn
*Assistant Examiner* — Tania Abraham
(74) *Attorney, Agent, or Firm* — Rankin, Hill & Clark LLP

(57) ABSTRACT

A lounge chair assembly includes a lounge chair and a cover. The lounge chair includes a frame having longitudinal frame members, lateral frame members extended between the longitudinal frame members, and legs connected to the frame members. A main seat and a backrest are supported by the frame. The main seat and the backrest together define a supporting outer surface of the lounge chair. The cover protects the supporting outer surface. The cover includes a body and at least one flap extended outwardly from the body. The body is made of a weather-resistant material having a perimeter sized and shaped substantially similar to an outer perimeter of the outer surface. The at least one end flap is configured for releasable engagement to the lounge chair for holding the cover to the lounge chair.

17 Claims, 14 Drawing Sheets

(56) References Cited

U.S. PATENT DOCUMENTS

| | | | | |
|---|---|---|---|---|
| 9,307,840 | B2 * | 4/2016 | Restrepo | A47C 7/62 |
| 2007/0210628 | A1 * | 9/2007 | Arnold | A47C 31/11 297/229 |
| 2009/0001790 | A1 | 1/2009 | Williams | |
| 2010/0001565 | A1 * | 1/2010 | Gray | A47C 7/624 297/229 |
| 2011/0260512 | A1 * | 10/2011 | Renda | A47C 31/11 297/219.1 |
| 2012/0242125 | A1 * | 9/2012 | Burns | A47C 31/11 297/219.1 |
| 2015/0015038 | A1 * | 1/2015 | Hampton | A47C 31/023 297/229 |
| 2017/0360214 | A1 * | 12/2017 | Jensen | B60N 2/6009 |

* cited by examiner

LOUNGE CHAIR WITH COVER

BACKGROUND

The present disclosure generally relates to lounge chairs and more specifically to covers for lounge chair sling material, cushions or pads.

Full body, outdoor recreational chairs, sometimes called lounge chairs, deck chairs, pool chairs, or the like, may be generally termed chaise lounges. They are typically constructed with a wood, plastic or metal tubular frame with the seat, back and leg support areas having straight or interwoven bands of plastic or fabric for support. A cushion or pad is typically provided on a support surface of the lounge chair for comfort. The cushion is generally comprised of foam or a fibrous batting, or a combination of each, and upholstered with plastic or woven materials designed to endure the elements.

Known chaise covers are used to protect the underlying cushion, or sling material of the chaise from getting dirty when not in use. Known chaise cover designs exist which are sized to cover the entire chaise frame and any cushions on the chaise. However, there is no convenient means of quickly deploying, later removing, folding and storing these known chaise covers.

SUMMARY

According to the present disclosure, a cover for protecting a supporting outer surface of a lounge chair or a cushion placed on the outer surface of the lounge chair is provided. The lounge chair includes a frame having a longitudinal frame member and lateral frame members. The exemplary cover comprises a body made of a weather-resistant material and first and second end flaps extended outwardly from the body. The body has a perimeter sized and shaped substantially similar to an outer perimeter of the outer surface. Each end flap is sized selectively to wrap around an outermost lateral frame member. Each end flap is configured for selective engagement to the respective outermost lateral frame member for holding the cover to the lounge chair.

According to one aspect, a lounge chair assembly includes a lounge chair and a cover. The lounge chair includes a frame having longitudinal frame members, lateral frame members extended between the longitudinal frame members, and legs connected to the frame members. A main seat and a backrest are supported by the frame. The main seat and the backrest together define a supporting outer surface of the lounge chair. The cover protects the supporting outer surface. The cover includes a body and at least one flap extended outwardly from the body. The body is made of a weather-resistant material having a perimeter sized and shaped substantially similar to an outer perimeter of the outer surface. The at least one end flap is configured for releasable engagement to the lounge chair for holding the cover to the lounge chair.

DETAILED DESCRIPTION

Figure 1A:
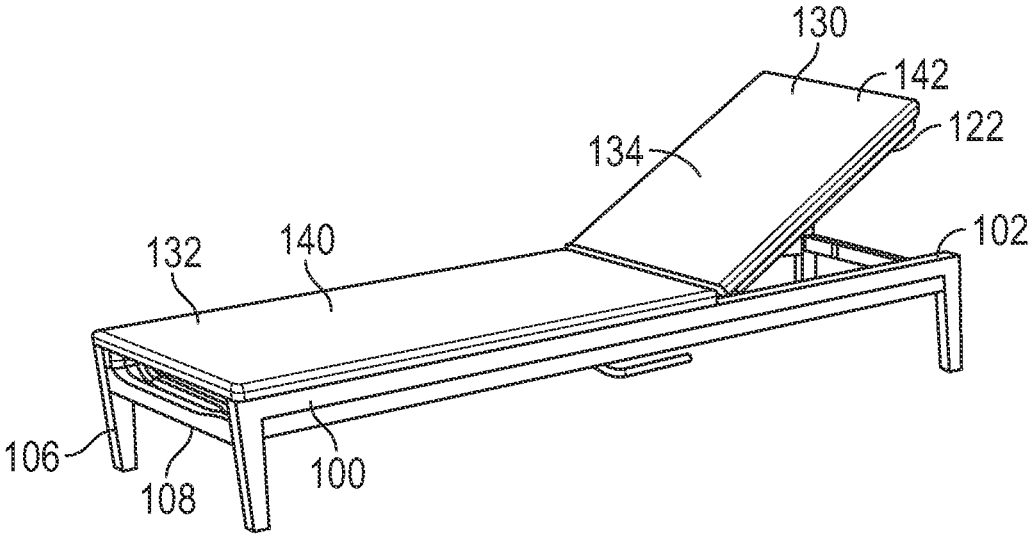
FIGS. 1*a* and 1*b* are perspective views of an exemplary lounge chair according to one aspect of the present disclosure, the exemplary lounge chair having a first type of cushion supported thereon.

It should, of course, be understood that the description and drawings herein are merely illustrative and that various modifications and changes can be made in the structures disclosed without departing from the present disclosure. Spatially relative terms may be used to describe an element and/or feature's relationship to another element(s) and/or feature(s) as, for example, illustrated in the figures. Moreover, any term of degree used herein, such as "substantially" and "approximately", means a reasonable amount of deviation of the modified word is contemplated such that the end result is not significantly changed.

Referring now to the drawings, wherein like numerals refer to like parts throughout the several views, FIGS. 1*a*, 1*b*, 2*a* and 2*b* depict an exemplary lounge chair or chaise lounge 100 according to one aspect of the present disclosure. The lounge chair 100 includes a frame 102 defined by longitudinal frame members 104 supported by legs 106 and lateral frame members 108 spanning between the longitudinal frame members 104. Supported by the frame 102 are a seat/foot portion 120 (hereafter main seat 120) and back/head portion 122 (hereafter backrest 122), which can be selectively adjusted relative the main seat 120 via an adjustment mechanism 126. The main seat and backrest 120, 122 define a supporting outer surface 128 (FIG. 3) of the lounge chair 100. It should be appreciated that the lateral frame members 108 can be slightly concave shaped (see FIG. 7) to allow for depression of the main seat and backrest 120, 122 during use.

An optional cushion or pad 130 removably rests on and substantially covers the supporting outer surface 128 including the main seat and backrest 120, 122. As depicted, the cushion 130 has a lower portion 132 superposed upon the main seat 120 when in use, the lower portion 132 terminating in a lower end, and an upper portion 134 superposed upon the backrest 122 when in use, the upper portion terminating in an upper end. It should be appreciated that the cushion 130 can be simply placed atop the main seat and backrest 120, 122, or the cushion can be releasably connected to the main seat and backrest 120, 122. For example, the cushion can be provided with straps that connect to the main seat and backrest 120, 122, the straps maintaining the relative position of the cushion 130 atop the supporting outer surface 128 of the lounge chair 100 as the backrest 122 is selectively adjusted relative to the main seat 120. The straps can be elastic straps and/or hook and loop type (e.g., Velcro®) straps. It should be noted that the cushion can be secured to the chaise lounge 100 using any appropriate method.

Figure 1B:
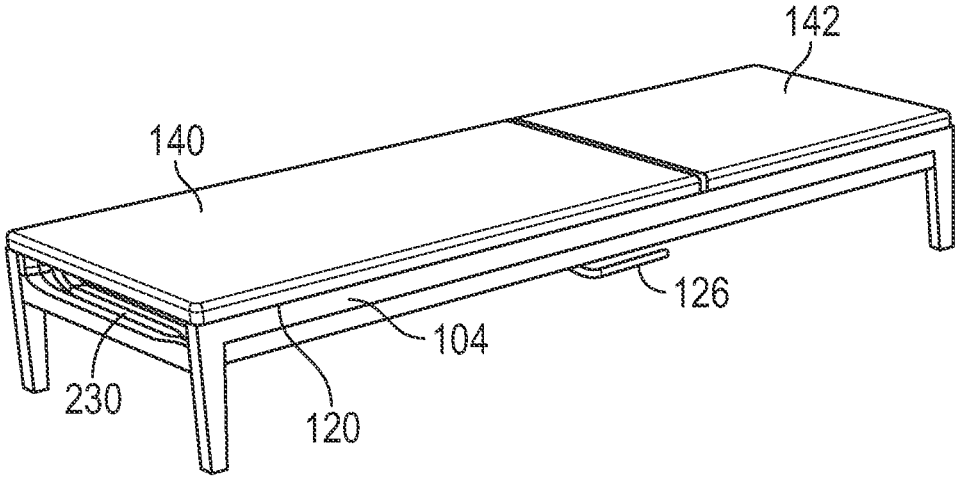
Figure 2A:
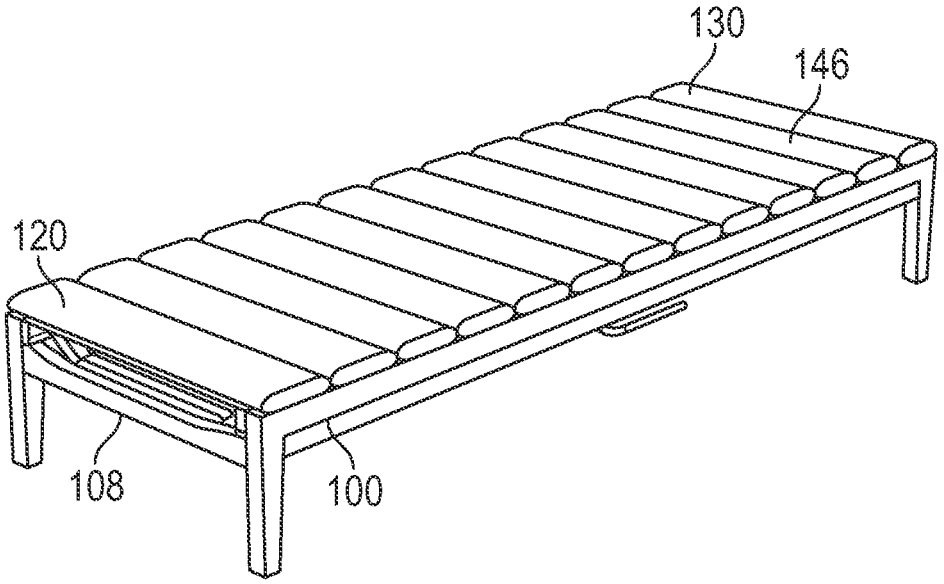
FIGS. 2*a* and 2*b* are perspective views of the exemplary lounge chair having a second type cushion supported thereon.
Figure 2B:
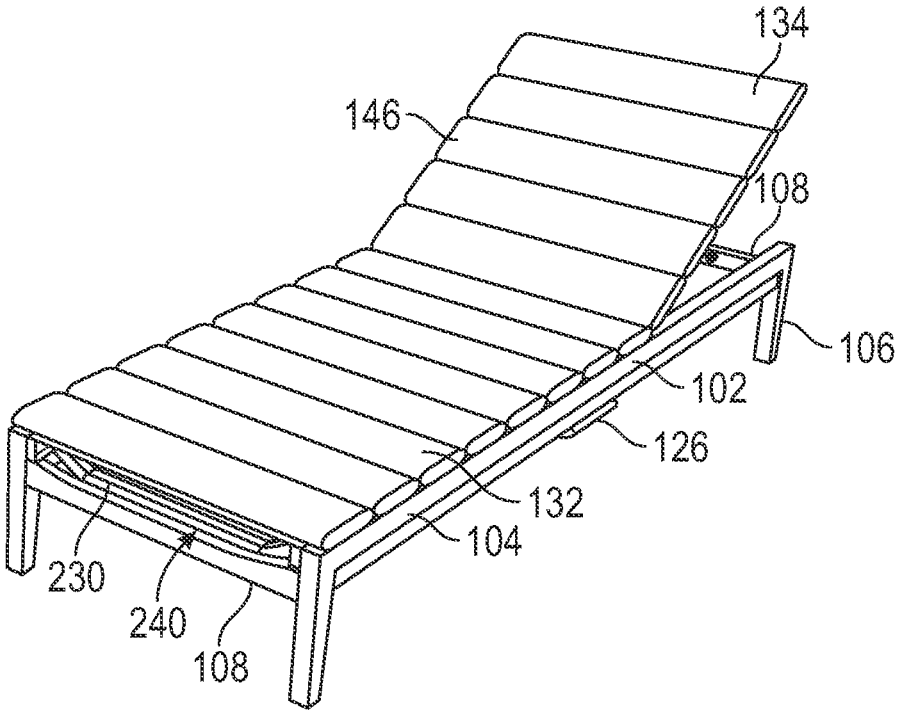

In FIGS. 1*a* and 1*b*, the cushion 130 is defined by two interconnected panels 140, 142, one of the panels defining the lower portion 132 and the other of the panels defining the upper portion 134. In FIGS. 2*a* and 2*b*, the cushion 130 is defined by a plurality of interconnected slats 146, which allows that style of the cushion to be compactly rolled up for storage.

Figure 3:
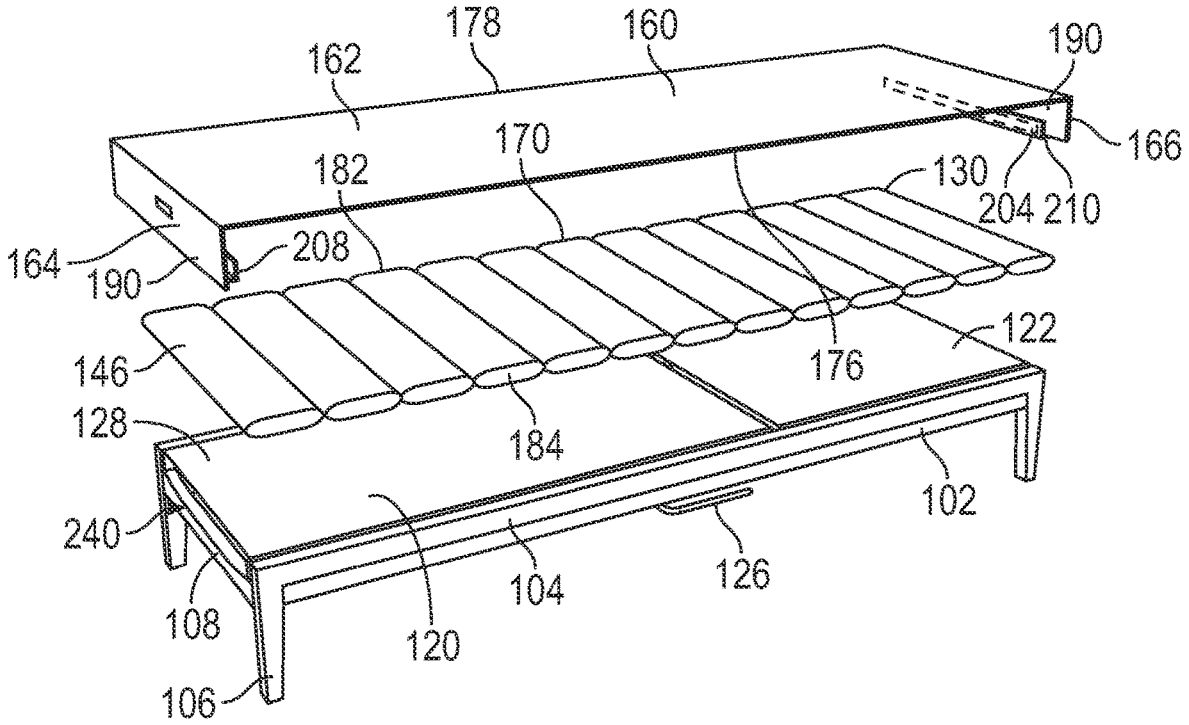
FIG. 3 is a perspective view of the exemplary lounge chair FIG. 2*a* with the second type cushion spaced from the exemplary lounge chair and a cover.

With reference to FIG. 3, a cover 160 is provided with the lounge chair 100 for selectively covering the cushion 130, which is depicted as the slatted style. The cover 160 is preferably made from any suitable material that is weatherproof and can withstand the adverse effects of extended durations of sunlight, including UV exposure and excessive heat, and extreme cold, without degradation or damage. According to one aspect, the cover 160 is formed of a flexible material that can be optionally coated or otherwise treated with various waterproof and UV protective layers. The term "weatherproof" is used in this application to include materials which have protective properties that are considered to be waterproof, weatherproof, water-resistant, and weather-resistant and further includes any such material that provides any type of protection from the elements, including protection from rain, sleet, snow, dust, dirt, leaves, and ultraviolet light from sunlight, and also from other harmful things, such as spilled drinks and food.

The cover 160 includes a main body 162, a lower end flap 164 extended from a lower end of the main body and an upper end flap 166 extended from an upper end of the main body. The body 162 is sized and shaped to closely match an outer perimeter 170 of the cushion 130, such that side edges 176, 178 of the body are approximately aligned with corresponding side edges 182, 184 of the cushion 130 that define the outer perimeter 170. The body 162 can be sized such that the side edges 176, 178 do not fold over or extend beyond the side edges 182, 184 of the cushion 130. The cover 160 may extend beyond the side edges 182, 184 of cushion 130 according to other embodiments. The end flaps 164, 166 are sized and shaped to extend beyond the respective lower and upper ends of the cushion 130, and as described in greater detail below, are used to secure the cover 160 to the frame 102. At least one of the end flaps 164, 166 can include a support panel 190, which is sized and shaped specifically to conform snugly against respective opposite rear end and front end lateral frame members 108 of the frame 102 during securement of the cover 160, as described below. In the depicted aspect, the panel 190, provided in the at least one, preferably both, of the end flaps 164, 166, is rigid or semi-rigid panel and is substantially rectangular shaped such that the respective end flap 164, 166 drapes beyond the front and rear edges of the cushion 130 and resides generally parallel and adjacent to the lateral frame member 108 of the frame 102. In the depicted aspect, each end flap 164, 166 includes the panel 190. The panel 190 can be used to keep the cover 160 straight and aligned when the cover 160 is positioned on the lounge chair 100. The panel 190 can also provide rigidity to help the user fold the cover 160 to prepare the cover 160 for storage. Though the end flaps 164, 166 are depicted as distinct portions of the cover 160 (e.g., a seam or fold line is depicted in FIG. 3), the end flaps 164, 166 could simply be respective extensions of the main body 162 that extend beyond the respective lower and upper ends of the cushion 130 and/or respective lower and upper ends of the lounge chair 100 (e.g., when no cushion 130 is provided) that are used to secure the cover 160 to the frame 102.

Figure 4A:
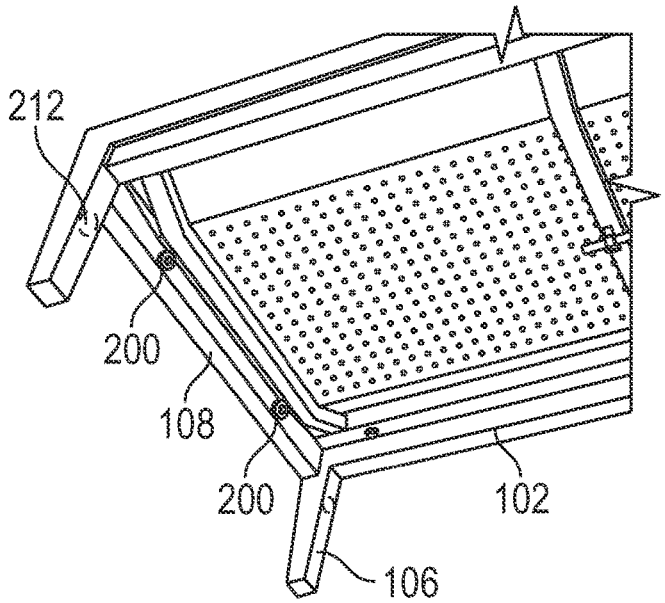
FIG. 4*a* is a partial underside view of FIG. 3.
Figure 4B:
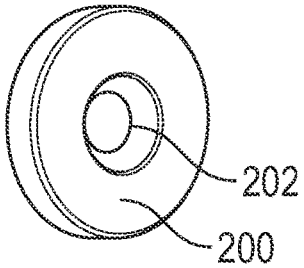
FIG. 4*b* is a perspective view of a magnet for use with the lounge chair of FIG. 4*a*.

According to the present disclosure, the end flaps 164, 166 are used to secure the cover 160 to the frame 102 by various means. According to an embodiment illustrated in FIGS. 4*a* and 4*b*, one or more magnets 200 are mounted to a section of the frame 102 of the lounge chair 100, preferably along an inside surface of each end most lateral frame member 108 (only one of the lateral frame members is shown in FIG. 4*a*). Alternatively, the magnets 200 can mount to an underside or lower surface of the end-most lateral frame members 108. The magnets 200 can be disc-shaped with a central and chamfered hole 202, sized to receive a screw or similar fastener (not shown) which allows the magnets 200 to be secured to the inside, underside or lower surface of each lateral frame member 108. With reference back to FIG. 3, a strip 204 of ferromagnetic material, such as iron, and iron-containing alloys, such as steel, is attached to a portion of each end flap 164, 166, and sized, shaped and positioned so that the strip 204 aligns with the magnets 200 when the end flaps 164, 166 are flipped under the lateral frame members 108. Of course, although the use of magnets 200 are preferred to secure the cover 160 to the frame, other attachment methods may be used without departing from the gist of the present invention, including various mechanical fasteners, such as plastic or metal snaps, tie-straps, and Velcro®.

With reference to FIG. 3, an extension portion 208 extends from a lower edge of the lower end flap 164, and another extension portion 210 extends from a lower edge of the upper end flap 166. The extension portions 208, 210 are shaped to conform to an underside of the lateral frame member 108, e.g., can be L-shaped to wrap around a respective lateral frame member 108. The extension portions 208, 210 can be flexible material so that they are conformable to the lateral frame member 108. These extensions do not have to include rigid panels. A respective strip 204 can provided in each extension portion. The extension portion 208, 210 on each end flap 164, 166 is shorter in the lateral direction as compared to the portion of each end flap from which it extends. This allows the lower end flap 164 to cover a portion of each leg 106 at the lower end of the lounge chair 100 while providing a cutout at each lateral end to accommodate the respective leg 106 when the extension portion 208 is wrapped around the respective lateral frame member 108. Similarly, the upper end flap 166 can cover a portion of each leg 106 at the upper end of the lounge chair 100 while providing a cutout at each lateral end to accommodate a respective leg 106 when the extension portion 210 is wrapped around the respective lateral frame member 108. Additionally, the lower end flap 164 can be longer as measured longitudinally (i.e., in a vertical direction in FIG. 3) than the upper end flap 166, and thus so can the respective panel 190 (e.g., the panel 190 associated with the upper end flap 166) can be longer as measured longitudinally (i.e., in a vertical direction in FIG. 3) than the panel 190 associated with the upper end flap 166. The different lengths can provide an indication to the operator as to how to attach the cover 160. The respective lengths (measured vertically in FIG. 3) of the end flaps 164 and 166 are sized to accommodate the lounge chair 100 either with or without the cushion 130. In lieu of the end flaps 164 and 166, vertically-displaced strips can be provided on each end so that in each case, a strip will align with a respective magnet. Ferromagnetic material can be provided with, in or connected to each strip for magnetic engagement with an associated magnet 200. Also, the lateral frame member 108 at the lower end of the lounge chair 100 may be offset vertically from the main seat 120 a greater distance in the vertical direction as compared to the distance that the lateral frame member 108 at the upper end of the lounge chair 100 is offset from backrest 122. As such, the end flaps 164, 166 can be appropriately sized to accommodate this.

The strips 204 may be secured to the end flaps 164, 166 using any appropriate method, such as an adhesive or fasteners (not shown). Preferably, the strips 204 are secured in pockets formed in the extension portions to protect the strips 204 from corrosion. It should be appreciated that recesses (not shown) can be formed within the inside surface of each lateral frame member 108, the recesses sized and shaped to snugly receive and retain the magnets 200. This allows the extension portion 208, 210 with the strip 204 to lie substantially flush with the inside surface of each lateral frame member 108.

According to another embodiment, each strip 204 may be made from a non-ferromagnetic material, such as wood or plastic. In this aspect, each strip 204 includes one or more bores (matching the number of magnets 200 used at each end flap 164, 166), each of which being sized and shaped for snugly receiving and supporting an insert. The insert is either a magnet, like magnet 200, or a ferromagnetic material, such as iron or an iron alloy. The thickness of each strip 204 is preferably equal to, or close to the thickness of the inserts so that the inserts lie flush to the planar surfaces of each strip, when residing within each respective bore. The bores are longitudinally spaced along each strip 204 so that they align with the locations of the magnets, when the end flap 164, 166 of the cover 160 are flipped around each respective end portion of the cushion 130 and the lateral frame members 108 during a cover-securing procedure. If magnets are used as inserts, then it is critical that the poles of the magnets are properly oriented so that magnets 200 are attracted to the aligned inserts with a pull force.

It should be noted that the above-mentioned magnets 200 may alternatively be made from a ferromagnetic material, such as iron, or an iron alloy, and does not have to be magnetic, just attracted to a magnet. In such instance, either each strip 204 must be magnetic, or the above-described inserts, if these are used, must be magnets. Regardless of the specific materials of each magnet 200, each strip 204, and—alternatively each insert, it is important that the end flaps 164, 166 and the lateral frame members 108 are configured and adapted to be magnetically attracted to each other with sufficient pull force to hold the cover 160 firmly to over the cushion 130 and to the frame 102 of the lounge chair 100. Although magnets are a preferred method to secure the cover 160, as described above, other effective methods may also be employed, such as using Velco®, small hooks, or mechanical push snaps in place of the magnets and strip, as easily understood by those of ordinary skill in the art.

Figure 5A:
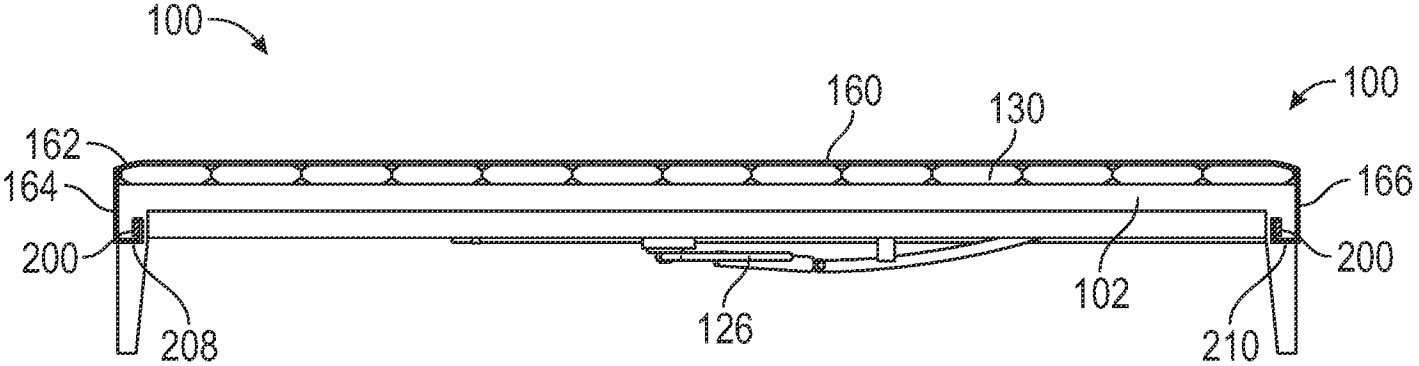
FIG. 5*a* is a side view of an exemplary cover positioned over the cushion of FIG. 2*a*.
Figure 5B:
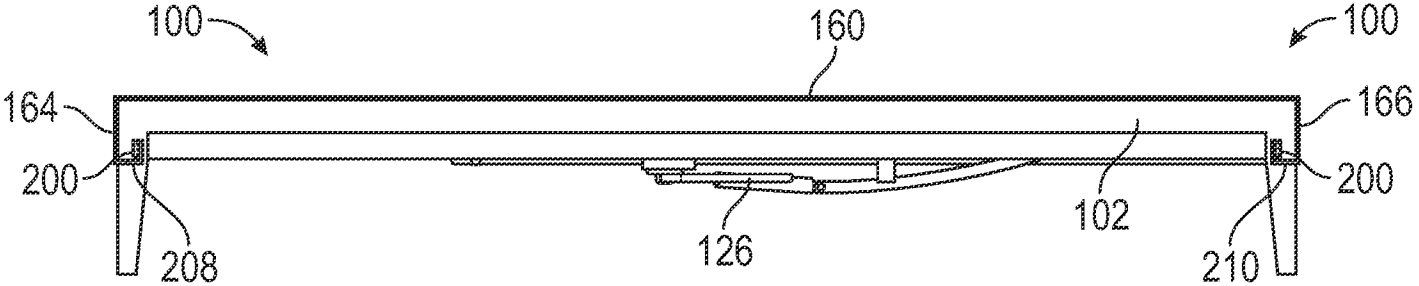
FIG. 5*b* is a side view of the exemplary cover positioned over the exemplary lounge chair without a cushion thereon.
Figure 7:
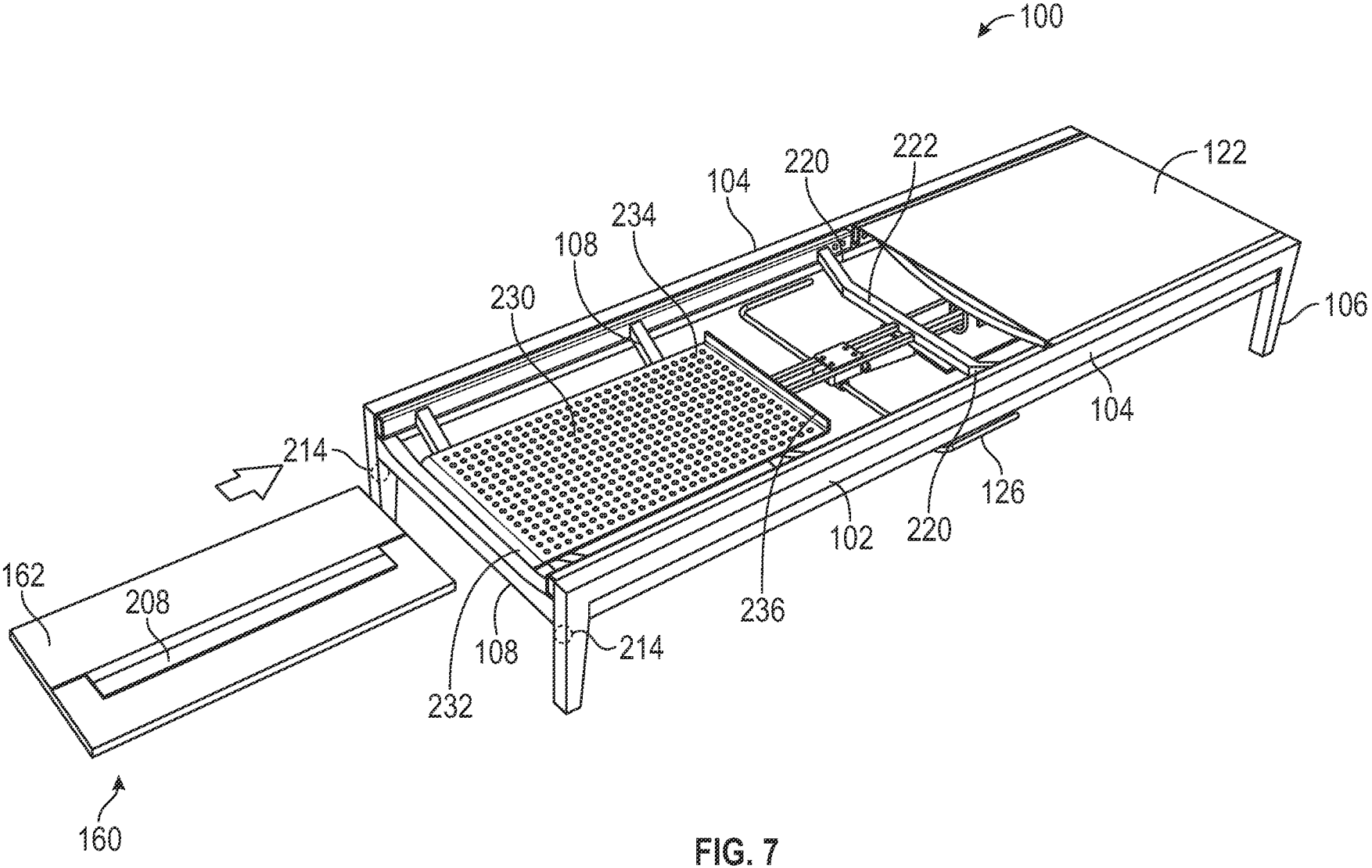
FIG. 7 is a perspective view of the exemplary lounge chair with a portion removed to more easily depict a storage area for the exemplary cover in a folded state.

FIG. 5*a* depicts the cover 160 secured over the cushion 130, which is depicted as the slatted style, with the end flaps 164, 166 magnetically connected to the frame 102 of the lounge chair 100 as described above. It should be appreciated that the cover 160 can be used with the lounge chair 100 without the cushion 130 provided thereon. FIG. 5*b* depicts such a use of the cover 160, where the cover 160 covers the main seat and backrest 120, 122 of the lounge chair 100 and the end flaps 164, 166 are magnetically connected to the frame 102, again as described above. As mentioned above, the end flaps 164, 166 extend beyond the respective lower and upper ends of the cushion 130 and/or respective lower and upper ends of the lounge chair 100 (e.g., when no cushion 130 is provided) and are used to secure the cover 160 to the frame 102. FIG. 4A shows an alternative mounting location 212 for the magnet 200 on an inner surface of each leg 106. FIG. 7 shows another alternative mounting location 214 for the magnet 200 on an outer surface of each leg 106. In a similar manner to that described above, although magnets are a preferred method to secure the cover 160, other effective fasteners could be employed in the alternative mounting locations, e.g. Velco®, small hooks, or mechanical push snaps in place of the magnets and strip, as easily understood by those of ordinary skill in the art.

Figure 6:
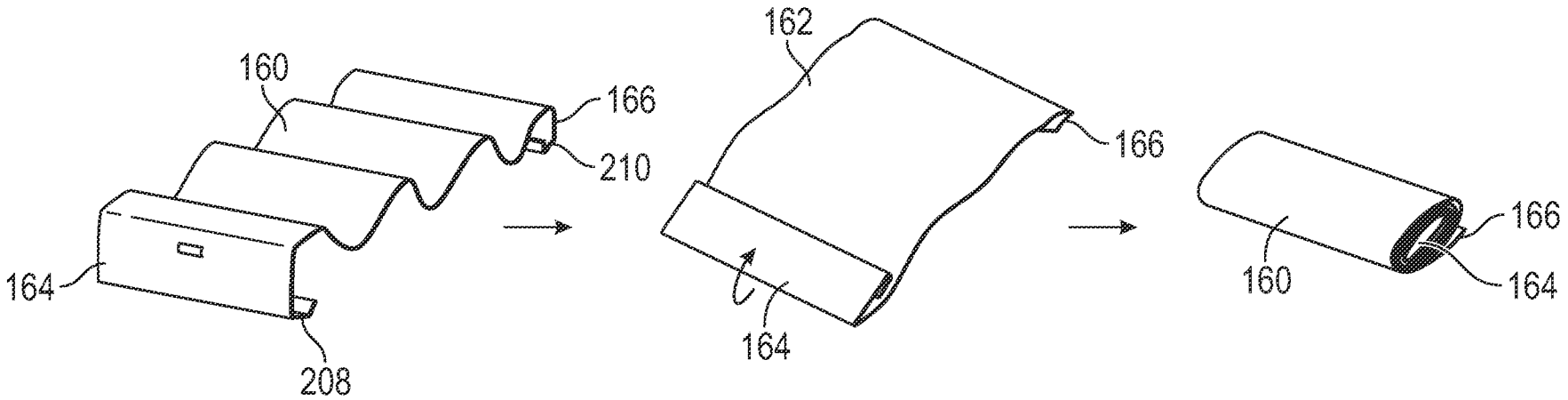
FIG. 6 depicts a folding of the exemplary cover for storage.

FIG. 6 shows one example of the cover 160 being folded for storage. The panel 190 provided in the end flap 166 is used to collect the body 162 of the cover 160 as the body is wrapped there-around to be stowed. This provides for a compact storage of the cover and also allows for ease of transport of the cover 160.

With reference to FIG. 7, the exemplary lounge chair 100 is configured and adapted to store the cover 160 when not in use. The chair 100 is depicted with the main seat 120 removed. As indicated, the frame 102 includes the lateral frame members 108 that span between the longitudinal frame members 104, and the lateral frame members 108 are slightly concave shaped to provide comfort for the user. To this end, the depicted lateral frame member 108 includes end sections 220 and a center section 222. The end sections 220 are secured to the lateral frame members and are extended obliquely downwardly therefrom to the center section 222. The center section 222 extends approximately horizontally between the end sections 220. The center sections 222 beneath the main seat 120 define a support for an inner panel 230. The inner panel 230 can be substantially rectangular shaped and includes opposite end portions 232, 234. The end portion 232 rests atop the outermost lateral frame member 108. The end portion 234 can include a flange 236 that serves as a backstop for the stored cover 160. Further, the inner panel 230 can be perforated, which can allow for air flow over the stored cover and drainage for any water that maybe on the stored cover 160. In the illustrated embodiment, the inner panel 230 is fixedly secured to the lateral frame members 108. However, it should be appreciated that the inner panel can be moveably secured to the lateral frame members, for example, by guide rails secured to the frame 102, thereby allowing the inner panel to move outwardly from the chair 100. As shown, for example, in FIGS. 2*b* and 5, with the main seat 120 secured on the frame 102, the main seat 120 together with the inner panel 230 define a storage area 240 within the lounge chair 100 for storage of the cover 160, and the outermost lateral frame member 108 together with the main seat 120 define an entrance to the storage area 240. In FIG. 7, the cover 160 is rectangularly folded for placement onto the inner panel 230; although, this is not required. For example, the folded cover 160 in FIG. 6 can be stored in the storage area.

In use, according to one embodiment of the invention, the cover 160 may be quickly and easily applied to the lounge chair 100 by first laying the folded cover 160 across the cushion 130. The user simply unfolds the cover 160, and when the cover 160 is spread flat across the cushion, and aligned with the outer perimeter 170 of the cushion 130, one selected end flap 164, 166 is pulled down and under the respective lateral frame member 108 so that strip 204 aligns with and is attracted to the magnets 200 located on the inside surface of the respective lateral frame member 108. The user then repeats this step with the opposite end flap, securing the other strip 204 to the respective magnets 200. The cover 160 is now attached to the lounge chair 100. To remove, the user simply pulls each end flap 164, 166 until the pulling force of the user overcomes the pulling force between the magnets 200 and the strip 204. Once both end flap 164, 166 are detached, the cover 160 can then be folded (e.g., around either rigid or semirigid panel 190) to create a compact form. The folded cover 160 can then be stored in the storage area 240 of the lounge chair 100.

Figure 8:
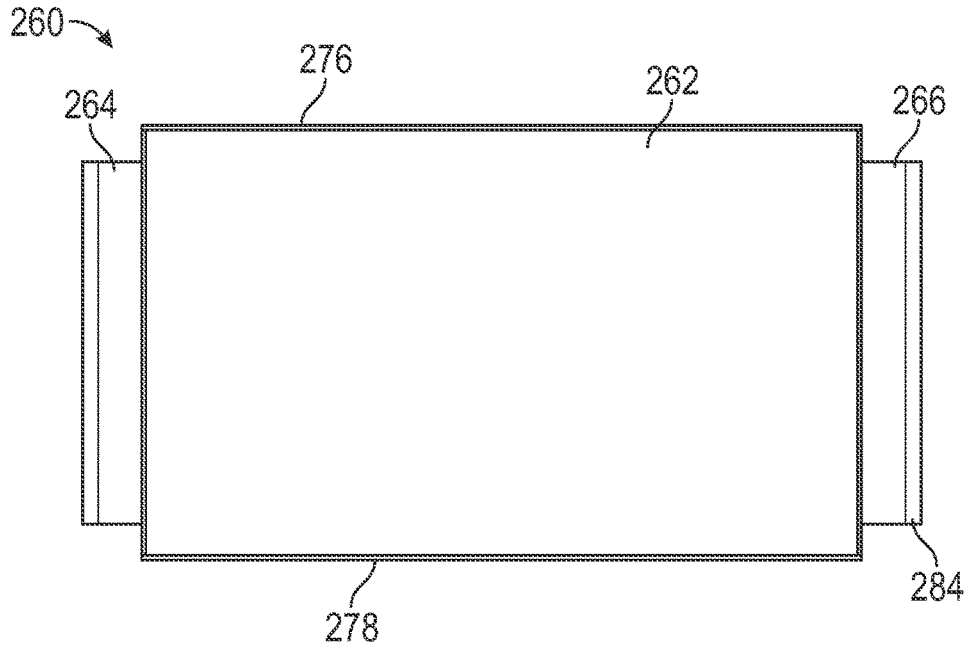
FIG. 8 is a top plan view of an alternative cover for the exemplary lounge chair.
Figure 9:
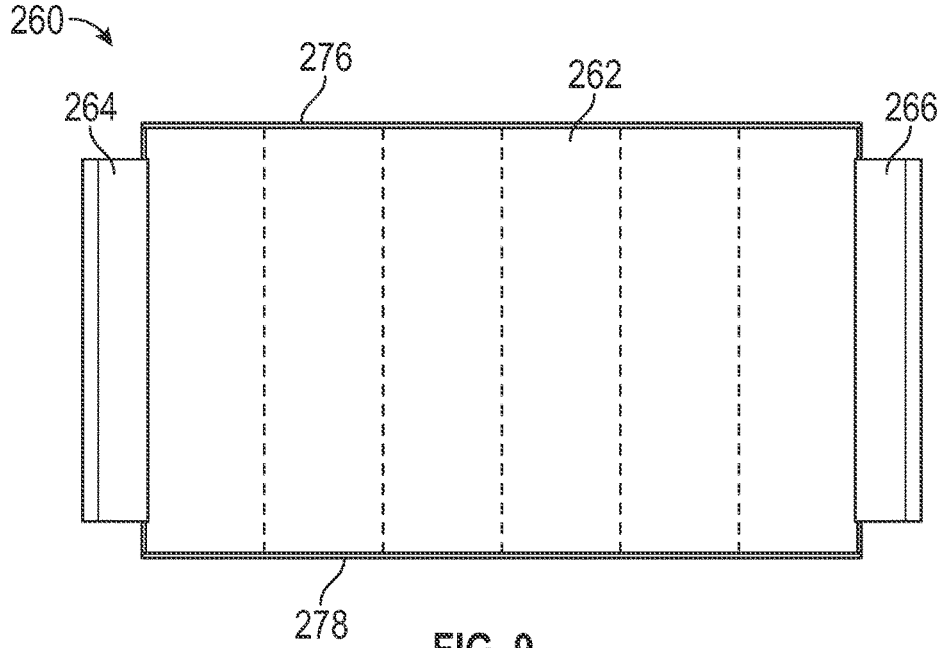
FIG. 9 is a bottom plan view of the alternative cover shown in FIG. 8.

FIG. 8 depicts an alternative cover 260 that is similar in configuration to the above described cover 160. The alternative cover 260 includes a main body 262, a lower end flap 264 extended from a lower end of the main body and an upper end flap 266 extended from an upper end of the main body. The body 262 is sized and shaped to closely match an outer perimeter 170 of the cushion 130 (see FIG. 3), such that side edges 276, 278 of the body 262 are approximately aligned with corresponding side edges 182, 184 of the cushion 130 that define the outer perimeter 170 (see FIG. 3). The body 262 can be sized such that the side edges 276, 278 do not fold over or extend beyond the side edges 182, 184 of the cushion 130. The cover 260 may extend beyond the side edges 182, 184 of cushion 130 according to other embodiments. The end flaps 264, 266 are sized and shaped to extend beyond the respective lower and upper ends of the cushion 130 and/or chair 100, and are used to secure the cover 260 to the frame 102 (see FIG. 3) in a similar manner to the cover 160 shown in FIG. 3. At least one of the end flaps 264, 266 can include a rigid or semi-rigid panel (similar to the panel 190 described above). If provided, the panel can be sized and shaped specifically to conform snugly against respective opposite rear end and front end lateral frame members 108 of the frame 102 during securement of the cover 260, in a similar manner to the cover 160 shown in FIG. 3. If provided, the panel can be provided in at least one, preferably both, of the end flaps 264, 266, and is substantially rectangular shaped such that the respective end flap 264, 266 drapes beyond the front and rear edges of the cushion 130 and/or chair 100 and resides generally parallel and adjacent to the lateral frame member 108 of the frame 102 in a similar manner to the cover 160 depicted in FIG. 3. Though the end flaps 264, 266 are depicted as distinct portions of the cover 260, the end flaps 264, 266 could simply be respective extensions of the main body 262 that extend beyond the respective lower and upper ends of the cushion 130 and/or respective lower and upper ends of the lounge chair 100 (e.g., when no cushion 130 is provided) that are used to secure the cover 260 to the frame 102.

A strip 284 of ferromagnetic material, such as iron, and iron-containing alloys, such as steel, is attached to a portion of each end flap 264, 266, and sized, shaped and positioned so that the strip 284 aligns with the magnets 200 when the end flaps 264, 266 are flipped under the lateral frame members 108 (see FIG. 3). Although the use of magnets 200 are preferred to secure the cover 260 to the frame 102 (see FIG. 3), other attachment methods may be used without departing from the gist of the present invention, including various mechanical fasteners, such as plastic or metal snaps, tie-straps, and Velcro®.

Figure 10:
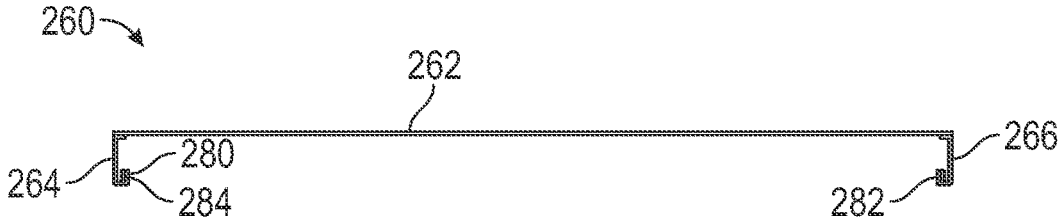
FIG. 10 is a side view of the alternative cover shown in FIG. 8.

With reference to FIG. 10, an extension portion 280 extends from a lower edge of the lower end flap 264, and another extension portion 282 extends from a lower edge of the upper end flap 266. The extension portions 280, 282 are shaped to conform to an underside of the lateral frame member 108, e.g., can be L-shaped (see FIG. 8) to wrap around a respective lateral frame member 108 similar to that shown in FIG. 3. The extension portions 280, 282 can be flexible material so that they are conformable to the lateral frame member 108. These extensions do not have to include rigid panels. A respective strip 284 can provided in each extension portion. The extension portion 280, 282 on each end flap 264, 266 is shorter in the lateral direction as compared to the portion of each end flap from which it extends. This allows the lower end flap 264 to cover a portion of each leg 106 at the lower end of the lounge chair 100 (similar to that shown in FIG. 3) while providing a cutout at each lateral end to accommodate the respective leg 106 when the extension portion 208 is wrapped around the respective lateral frame member 108. Similarly, the upper end flap 266 can cover a portion of each leg 106 at the upper end of the lounge chair 100 while providing a cutout at each lateral end to accommodate a respective leg 106 when the extension portion 282 is wrapped around the respective lateral frame member 108 similar to that shown in FIG. 3. Additionally, the lower end flap 264 can be longer as measured longitudinally (i.e., in a vertical direction in FIG. 3) than the upper end flap 266. The different lengths can provide an indication to the operator as to how to attach the cover 260. The respective lengths (measured vertically in FIG. 3) of the end flaps 264 and 266 are sized to accommodate the lounge chair 100 either with or without the cushion 130.

Strips 284 made from a ferromagnetic material may be secured to the end flaps 264, 266 using any appropriate method, such as an adhesive or fasteners (not shown). Preferably, the strips 284 are secured in pockets formed in the extension portions to protect the strips 284 from corrosion. Each strip 284 may be made from also be non-ferromagnetic material, such as wood or plastic. In this aspect, each strip 284 includes one or more bores (matching the number of magnets 200 used at each end flap 264, 266), each of which being sized and shaped for snugly receiving and supporting an insert. The insert is either a magnet, like magnet 200, or a ferromagnetic material, such as iron or an iron alloy. The thickness of each strip 284 is preferably equal to, or close to the thickness of the inserts so that the inserts lie flush to the planar surfaces of each strip, when residing within each respective bore. The bores are longitudinally spaced along each strip 284 so that they align with the locations of the magnets, when the end flap 264, 266 of the cover 260 are flipped around each respective end portion of the cushion 130 and the lateral frame members 108 during a cover-securing procedure. If magnets are used as inserts, then it is critical that the poles of the magnets are properly oriented so that magnets 200 are attracted to the aligned inserts with a pull force.

Figure 11:
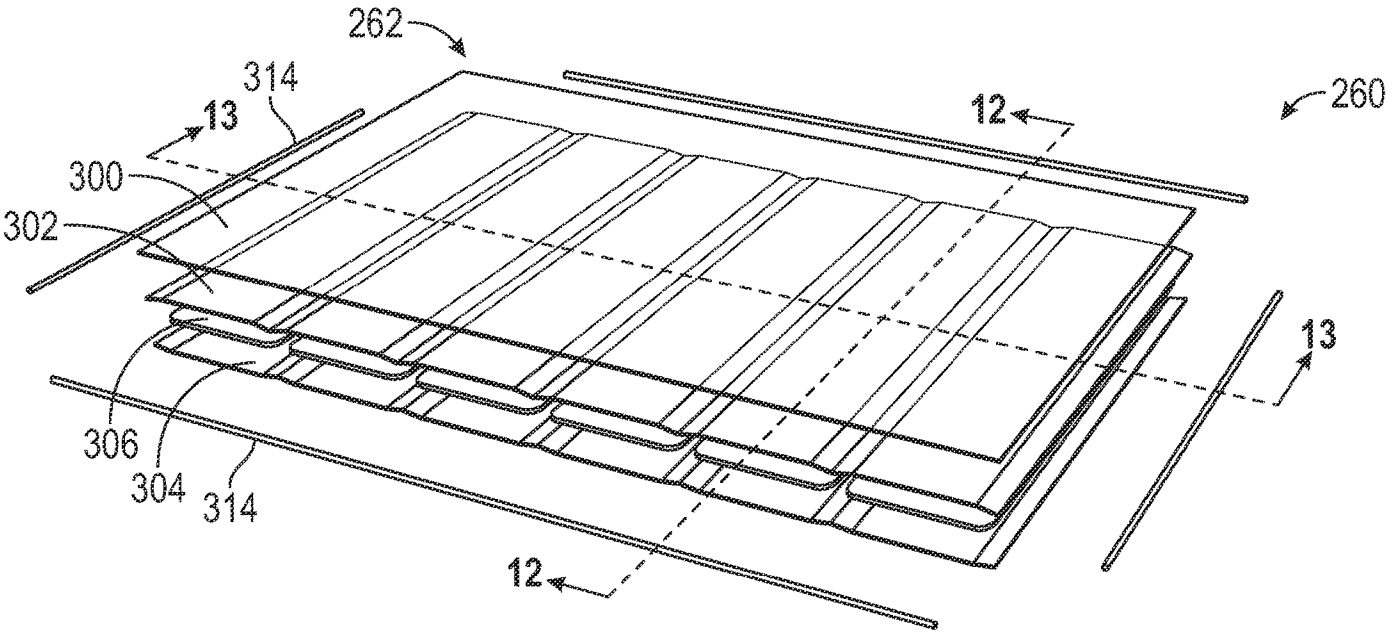
FIG. 11 is an exploded view of main body of the alternative cover shown in FIG. 8.

With reference to FIG. 11, the main body 262 includes an upper fabric layer 300, which can be made with a thermoplastic polyurethane (TPU). The main body 262 also includes a middle fabric layer 302, which can be made with a thin acrylic material. The main body 262 also includes a bottom fabric layer 304, which can be made with the same thin acrylic material as the middle fabric layer 302. The main body 262 can also include boards 306 positioned between the middle fabric layer 302 and the bottom fabric layer 304. The boards 306 can be made from plastic or other relatively more rigid material than that of the upper fabric layer 300, the middle fabric layer 302 and the bottom fabric layer 304. Each board 306 can be received in a respective pocket 308 formed when stitching 312 the middle fabric layer 302 to the bottom fabric layer 304.

Figure 12:
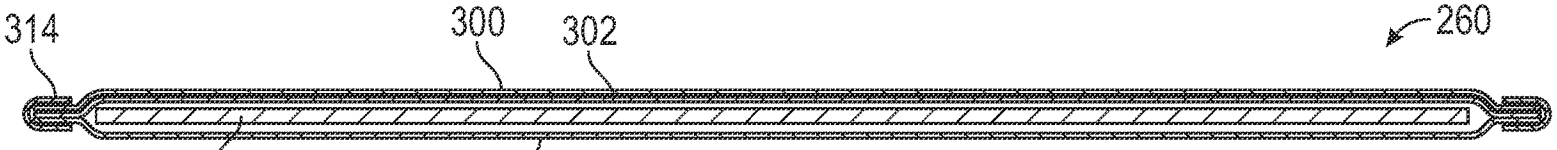
FIG. 12 is a cross-sectional view taken through line 12-12 in FIG. 11.
Figure 13:
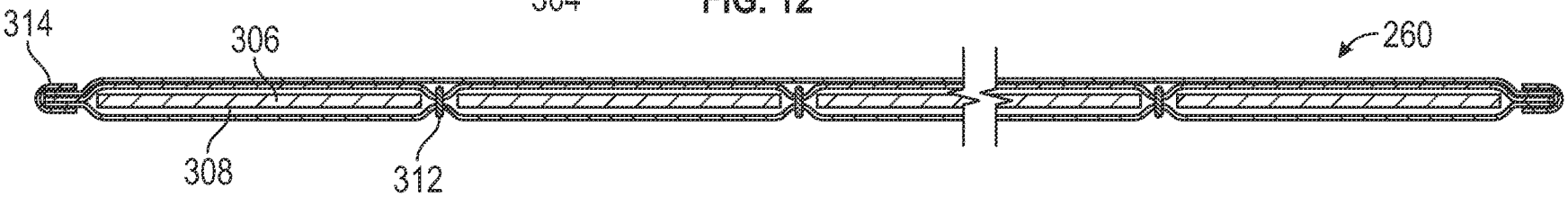
FIG. 13 is a cross-sectional view taken through line 13-13 in FIG. 11.

Bindings 314, which can be U-shaped (see FIGS. 12 and 13) can be used to attach the upper fabric layer 300 to the bottom fabric layer 304. Each binding 314 can be adhered to respective edges of the upper fabric layer 300 and the bottom fabric layer 304 and sandwich the middle fabric layer 302 between the upper fabric layer 300 and the bottom fabric layer 304. Four bindings 314 are shown in FIG. 11, thus totally surrounding the periphery of the main body 262. The upper fabric layer 300 is made from a waterproof fabric and has no stitching through it. By doing so, water penetration through the upper fabric layer 300 is greatly inhibited.

The alternative cover 260 is used in a similar manner to the above-described cover 160. The alternative cover 260 can be folded similarly to the cover 160 in FIG. 6 and can be received similarly in the storage area 240 within the lounge chair 100 similarly to the cover 160 shown in FIG. 7. The alternative cover 260 can also be configured to cooperate with the alternative mounting locations 212 shown in FIG. 4A and the other alternative mounting locations 214 shown in FIG. 7.

Figure 14:
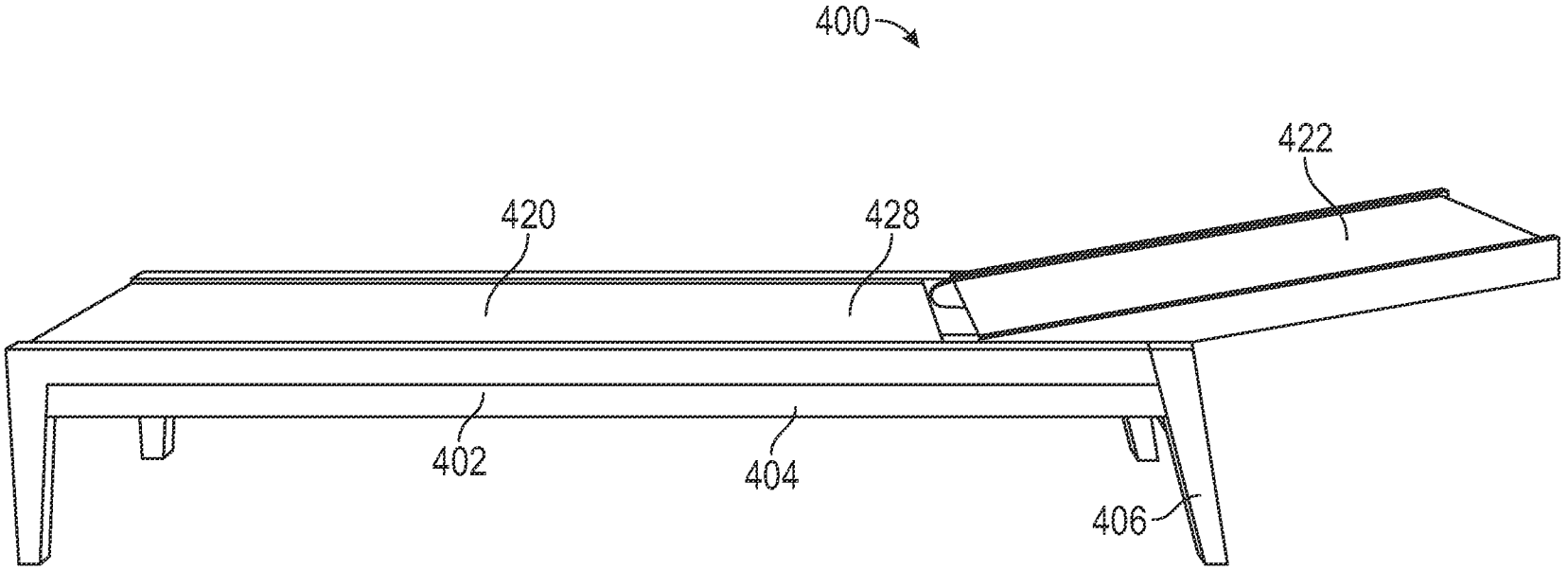
FIGS. 14 and 15 are perspective views of an exemplary lounge chair according to another aspect of the present disclosure.
Figure 15:
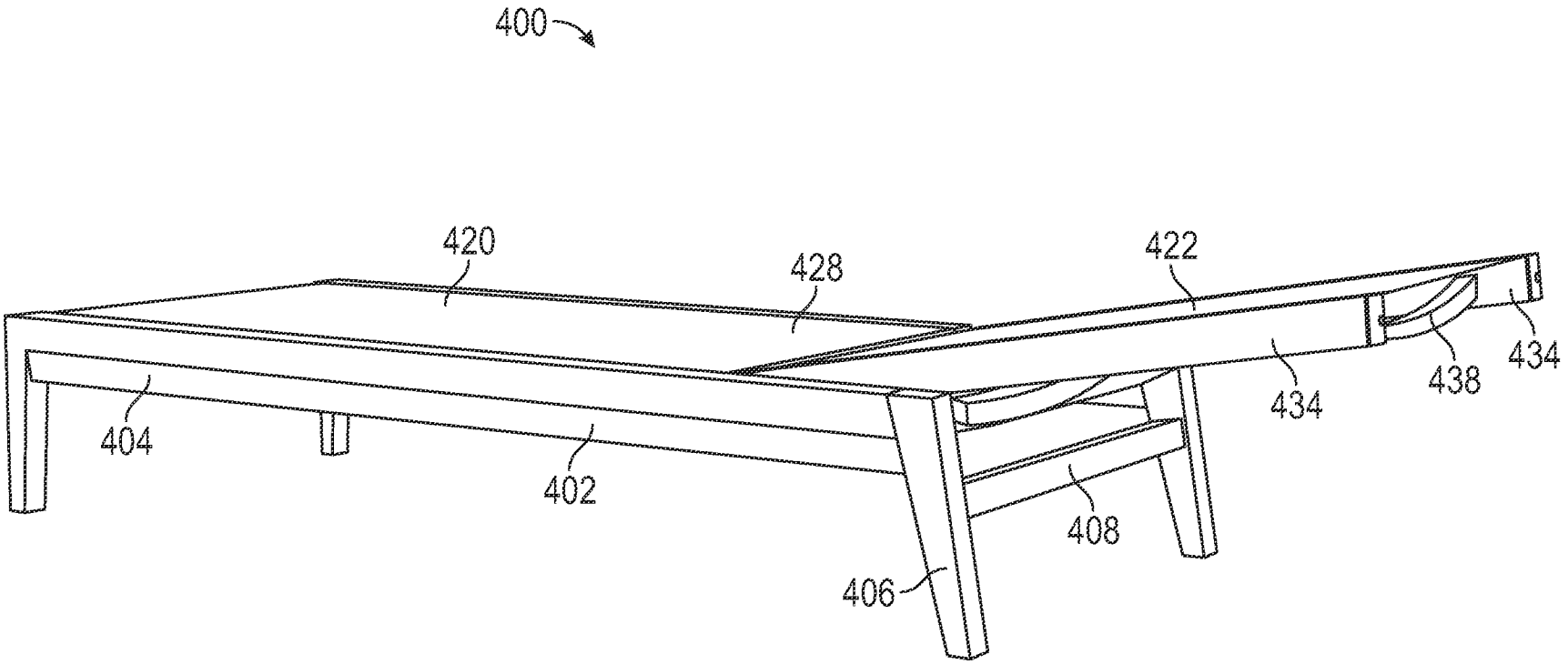

FIGS. 14 and 15 depict an exemplary lounge chair or chaise lounge 400 according to one aspect of the present disclosure. The lounge chair 400 includes a frame 402 defined by longitudinal frame members 404 supported by legs 406 and lateral frame members 408 spanning between the longitudinal frame members 404 and the legs 406. Supported by the frame 402 are a seat/foot portion 420 (hereafter main seat 420) and back/head portion 422 (hereafter backrest 422), which can be selectively adjusted relative the main seat 420 via an adjustment mechanism (not visible), which can be similar to adjustment mechanism 126. As depicted, the front end set of legs 406 and the front end lateral frame member 408 are located at or near a center section of the backrest 422. With this arrangement, a part of the backrest 422 extends outward from the frame 402 and is not directly supported by the frame in a horizontal flat position. The main seat and backrest 420, 422 define a supporting outer surface 428 of the lounge chair 400. It should be appreciated that the lateral frame members 408 can be slightly concave shaped (see FIG. 15) to allow for depression of the supporting outer surface 428 during use, thereby providing comfort for the user.

Figure 16A:
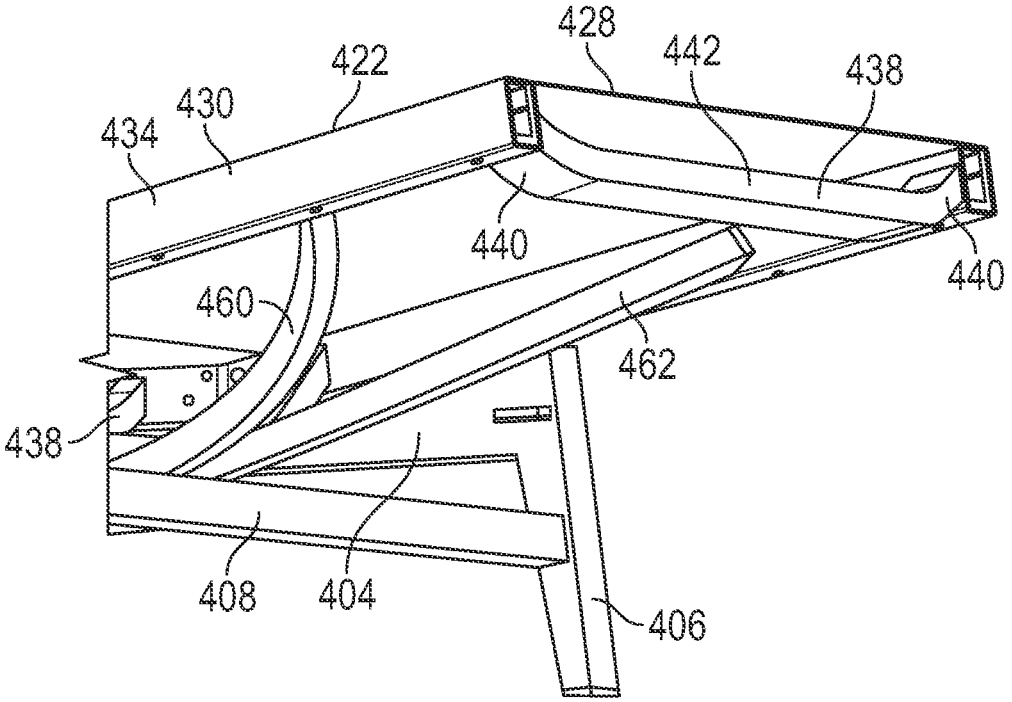
FIGS. 16*a* and 16*b* are partial underside perspective views of the exemplary lounge chair of FIGS. 14 and 15.
Figure 16B:
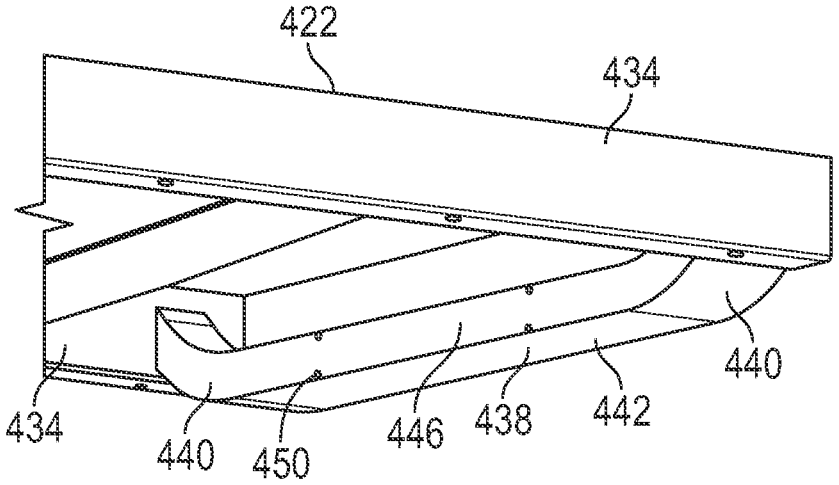

An underside of the backrest 422 is shown in FIGS. 16*a* and 16*b*. The backrest 422 includes a backrest frame 430 that is pivotally attached to the frame 402 at a hinge (not visible). The backrest frame 430 includes longitudinal frame members or rails 434 and lateral frame members or crossbars 438 spanning between the rails 434. Similar to the lateral frame members 408, each of the crossbars 438 can be curved downwardly and extend perpendicular to the respective rails 434 to which they connect. More particularly, each of the crossbars 438 includes end sections 440 connected to the rails 434 and a middle section 442 extending between the end sections 440. The end sections 440 are angled or curved downward such that the middle section 442 projects at least partially vertically below the rails 434. In the depicted aspect, each of the crossbars 438 is formed of a rectangular or square pipe, thereby having planar faces that are normal to each other. Therefore, the shape of the outermost or forwardmost crossbar 438 allows for connection of attachment features (e.g., the magnets 200) to, for example, an inward facing face 446 of the forwardmost crossbar 438. For example, in FIG. 16*b* threaded holes 450 are provided on the inward facing face 446 for securing magnets (not shown) to the inward facing face 446. This allows for the attachment of the cover 160, 260 to the lounge chair 400. Specifically, as it relates to cover 160 for example, the extension portion 208 provided on the support panel 190 of the upper end flap 166 is shaped to conform to or wrap around an underside of the forwardmost crossbar 438. The strip 204 in the extension portion 208 is magnetically connected to the magnets attached to the inward facing face 446 of the forwardmost crossbar 438. It should be appreciated that by securing the cover 160, 260 directly to the forwardmost crossbar 438, the cover can be easily moved together with the backrest 422 relative to the main seat 420 without interference with the frame 402. Further depicted in FIG. 16*a* are braces 460, 462. The braces 460, 462 extend between the respective rails 434 and the adjustment mechanism.

Figure 17A:
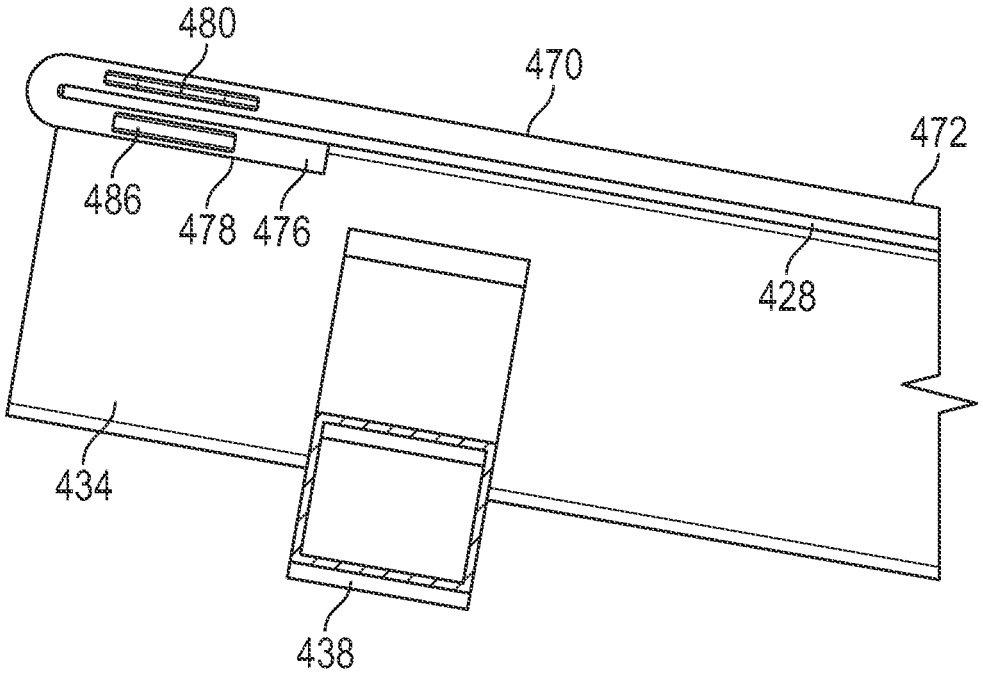
FIGS. 17*a*, 17*b* and 17*c* are partial perspective cross-sectional views of an exemplary cover positioned over the exemplary lounge chair of FIGS. 14 and 15.
Figure 17B:
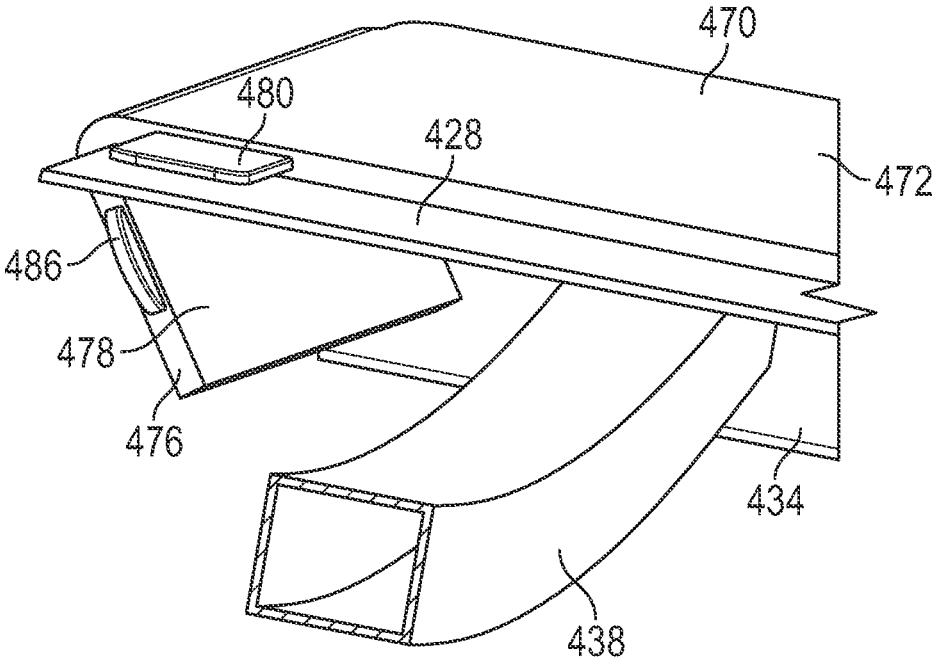
Figure 17C:
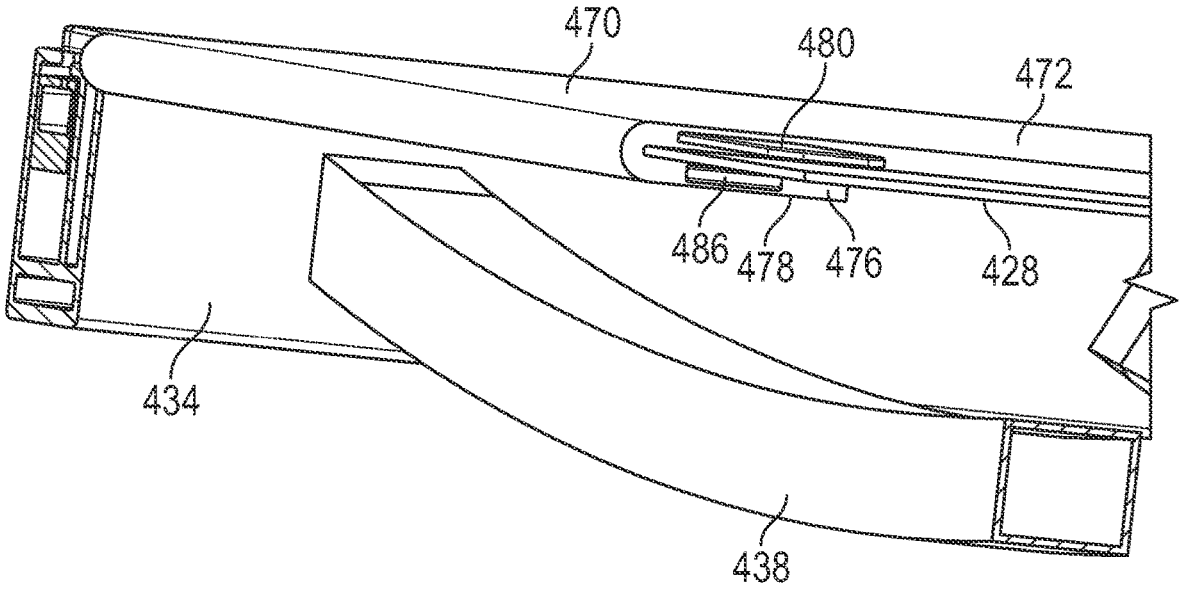

With reference now to FIGS. 17*a*, 17*b* and 17*c*, a cover 470 according to another aspect of the present disclosure is removably connected to the supporting outer surface 428. The cover 470 includes a main body 472 and end flaps 476 extended from the main body (only one end flap is shown). Similar to the covers 160, 260 described above, the body 472 is sized and shaped to closely match an outer perimeter of the supporting outer surface 428. The end flaps 476 include support panels 478 sized and shaped to conform against the supporting outer surface 428 during securement of the cover. The support panels 478 extend beyond the ends of the supporting outer surface 428 (and optionally the ends of the cushion 130 if placed atop the supporting outer surface 428), and are folded under the backrest 422. According to one aspect, a strip 480 is secured within the cover 470 and extends laterally on the cover, one strip provided along each end portion of the cover. The strip 480 is like the strip 204 in the extension portion 208 of each end flap of the cover 160, and is formed of ferromagnetic material, such as iron, and iron-containing alloys, such as steel. Preferably, the strip 480 is secured in a pocket formed in each end portion of the cover 470 to protect the strip 480 from corrosion, and may be secured in the pocket using any appropriate method, such as an adhesive. At least one magnet 486 is provided in each end flap 476 to be magnetically connected to each strip 480 when each end flap 476 is folded under each end portion of the cover 470. The at least one magnet 486 can be an elongated strip made from a ferromagnetic material or can be spaced magnets similar to magnets 200. Preferably, at least one magnet 486 is also secured in at least one pocket formed in the end flaps 476 to protect the at least one magnet 486 from corrosion, and may be secured in the at least one pocket using any appropriate method, such as an adhesive. It should be appreciated that by securing the cover 470 directly to the supporting outer surface 428, the cover can be easily moved together with the backrest 422 relative to the main seat 420 without interference with the frame 402.

Figure 18A:
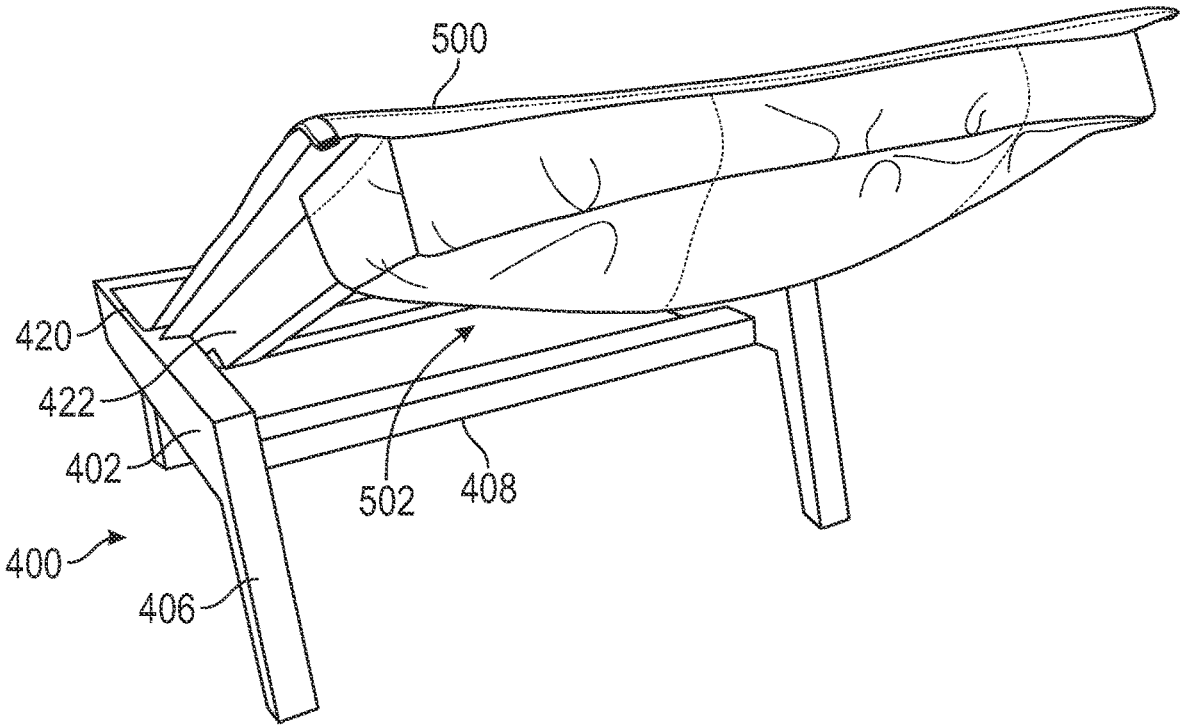
FIGS. 18*a* and 18*b* are partial perspective views of another exemplary cover positioned over the exemplary lounge chair of FIGS. 14 and 15.
Figure 18B:
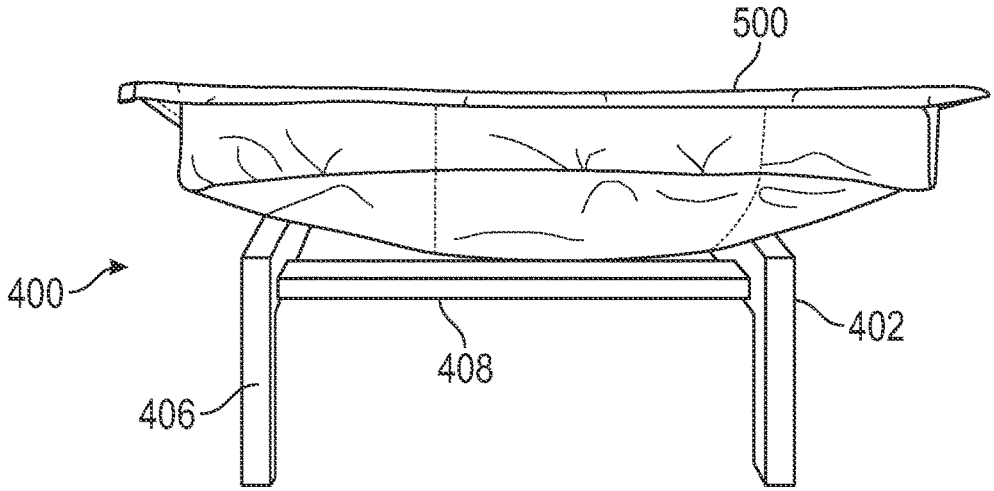

FIGS. 18*a* and 18*b* depict another cover 500 for use with the lounge chair 400. According to this aspect, a pocket 502 is provided at a front end portion of the cover, the pocket sized to receive the backrest 422 (and optionally the end of the cushion 130 if placed atop the supporting outer surface 428). A rear end portion of the cover 500 can include an end flap that can be secured in a similar manner as the covers described above.

It will be appreciated that of the above-disclosed embodiments and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the present disclosure.

The invention claimed is:

1. A lounge chair assembly comprising:

a lounge chair including:

a frame having longitudinal frame members, lateral frame members extended between the longitudinal frame members, and legs connected to the frame members, and a main seat and a backrest supported by the frame, the main seat and the backrest together define a supporting outer surface of the lounge chair; and a cover for protecting the supporting outer surface, the cover including:

a body made of a weather-resistant material having a perimeter sized and shaped substantially similar to an outer perimeter of the outer surface, and at least one end flap extended outwardly from the body, wherein the at least one end flap is configured for releasable engagement to the lounge chair for holding the cover to the lounge chair, wherein the at least one end flap is adapted to be magnetically attached to one of an end portion of the frame and the end portion of the backrest.

2. The lounge chair assembly of claim 1, wherein the least one end flap is sized and shaped to conform against one of an end portion of the main seat and an end portion of the backrest during securement of the cover.

3. The lounge chair assembly of claim 2, wherein the at least one end flap and an extension portion extending from an edge of the at least one end flap define a lateral cutout at each lateral end to accommodate a respective leg.

4. The lounge chair assembly of claim 1, wherein the at least one end flap includes a first end flap extended from a first end portion of the body, the first end flap is adapted to be magnetically attached to one of a forwardmost lateral frame member and the end portion of the backrest.

5. The lounge chair assembly of claim 4, wherein the backrest includes a backrest frame having longitudinal rails and lateral crossbars extended between the rails, the first end flap includes a metallic strip and at least one magnet is provided on an outermost crossbar of the backrest frame.

6. The lounge chair assembly of claim 5, wherein the outermost crossbar includes end sections connected to the rails and a middle section extending between the end sections, the end sections are angled or curved downward such that the middle section projects at least partially below the rails, wherein the outermost crossbar is formed of a rectangular or square pipe having planar faces, the at least one magnet is provided on an inward facing face of the outermost crossbar.

7. The lounge chair assembly of claim 4, wherein the at least one end flap includes a second end flap extend from a second end portion of the body, the second end flap includes a metallic strip and at least one magnet is provided on one of a rearmost lateral frame member of the frame and on each rear leg.

8. The lounge chair assembly of claim 1, including a removable cushion for placement on the supporting outer surface, the cover adapted to protect an outer surface of the cushion and releasably hold the cushion atop the supporting outer surface.

9. The lounge chair assembly of claim 1, wherein the frame defines a storage area sized to receive the cover in a folded state.

10. The lounge chair assembly of claim 9, wherein the storage area is defined by an inner panel secured to at least two of lateral frame members of the frame.

11. The lounge chair assembly of claim 9, wherein the main seat further defines the storage area, and an outermost lateral frame member of the frame and the main seat define an entrance to the storage area.

12. The lounge chair assembly of claim 1, wherein a pocket is provided at a front end portion of the cover, the pocket sized to receive the backrest.

13. A cover for protecting a supporting outer surface of a lounge chair or a cushion placed on the supporting outer surface of the lounge chair, the lounge chair includes a frame having longitudinal frame members and lateral frame members, a main seat and a backrest supported by the frame and together define the supporting outer surface, the cover comprising:

a body made of a weather-resistant material having a perimeter sized and shaped substantially similar to an outer perimeter of the outer surface; and first and second end flaps extended outwardly from the body, wherein each end flap is configured for releasable engagement to the lounge chair for holding the cover to the lounge chair, wherein at least one of the end flaps is adapted to be magnetically attached to the frame.

14. The cover of claim 13, wherein at least one of the end flaps includes a support panel which is sized and shaped to conform against an end portion of the frame of the lounge chair during securement of the cover.

15. The cover of claim 13, wherein the at least one of the end flaps includes a metallic strip and at least one magnet is provided on a respective outermost lateral frame member.

16. The cover of claim 15, wherein the at least one of the end flaps is the first end flap, and the second end flap is adapted to be magnetically attached to a backrest frame of the backrest.

17. The cover of claim 16, wherein the second end flap includes a metallic strip and at least one magnet is provided on the backrest frame.

* * * * *